US008789623B2

(12) United States Patent
Duckworth et al.

(10) Patent No.: US 8,789,623 B2
(45) Date of Patent: Jul. 29, 2014

(54) HIGH PERFORMANCE ROCK BIT GREASE

(71) Applicants: David P. Duckworth, Conroe, TX (US); Ping C. Sui, The Woodlands, TX (US); Liwen Wei, Bellaire, TX (US)

(72) Inventors: David P. Duckworth, Conroe, TX (US); Ping C. Sui, The Woodlands, TX (US); Liwen Wei, Bellaire, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/857,864

(22) Filed: Apr. 5, 2013

(65) Prior Publication Data

US 2013/0220704 A1 Aug. 29, 2013

Related U.S. Application Data

(62) Division of application No. 12/863,139, filed as application No. PCT/US2009/031269 on Jan. 16, 2009, now abandoned.

(60) Provisional application No. 61/022,241, filed on Jan. 18, 2008.

(51) Int. Cl.

| | |
|---|---|
| ***E21B 10/08*** | (2006.01) |
| ***C10M 169/02*** | (2006.01) |
| ***C10M 141/10*** | (2006.01) |
| ***C10M 159/24*** | (2006.01) |

(52) U.S. Cl.

USPC ..... 175/331; 508/113; 508/136; 508/155; 508/161; 508/179

(58) Field of Classification Search

USPC ..... 508/113, 129, 154, 136, 161, 155, 179; 175/331

See application file for complete search history.

(56) References Cited

U.S. PATENT DOCUMENTS

| | | | | |
|---|---|---|---|---|
| 2,614,079 | A | 10/1952 | Moore | 252/39 |
| 4,560,489 | A | 12/1985 | Muir et al. | 252/33.4 |
| 5,308,514 | A | 5/1994 | Olson et al. | 252/18 |
| 5,338,467 | A | 8/1994 | Olson et al. | 252/33.4 |
| 5,589,443 | A | 12/1996 | Denton et al. | 508/150 |
| 5,891,830 | A | 4/1999 | Koltermann et al. | 308/136 |
| 7,294,608 | B2 | 11/2007 | Oldiges et al. | 508/390 |
| 2004/0186025 | A1 | 9/2004 | Nakatani et al. | 508/130 |
| 2004/0214732 | A1 * | 10/2004 | Oldiges et al. | 508/390 |
| 2006/0254823 | A1 | 11/2006 | Denton et al. | 175/57 |

OTHER PUBLICATIONS

International Search Report and Written Opinion, PCT/US2009/031269, 10 pages, Mar. 27, 2009.

Läuger, Jörg et al., Temperature-Dependent Rheology and Tribology of Lubrication Greases, NLGI 75th Annual Meeting, Colonial Williamsburg, VA (15 pages), Jun. 7-10, 2008.

Anderson, Peter, "New Journal Bearing Tester: The VTT Water Tribotester," Technical Research Centre of Finland, Espoo.; 27 pgs., Aug. 1992.

International Search Report and Written Opinion, PCT/US2009/031269, 7 pages, May 16, 2012.

* cited by examiner

*Primary Examiner* — Vishal Vasisth

(74) *Attorney, Agent, or Firm* — Baker Botts L.L.P.

(57) ABSTRACT

The present disclosure relates to greases containing metal sulfonate thickeners. In one example the thickener may be a calcium sulfonate thickener. In other examples grease may contain a combination of a metal sulfonate thickener and another thickener, such as a metal complex soap grease, detergent, or non-soap thickener. The grease may be formulated to meet specific performance criteria relevant to lubrication of a roller cone drill bit in downhole conditions. The disclosure also relates to a roller cone drill bit containing a grease of the disclosure.

19 Claims, 3 Drawing Sheets

HIGH PERFORMANCE ROCK BIT GREASE

PRIORITY CLAIM

This present application is a divisional of U.S. patent application Ser. No. 12/863,139 filed Jul. 15, 2010, which is a U.S. National Stage Application of International Application No. PCT/US2009/031269 filed Jan. 16, 2009, which designates the United States and claims priority under 35 U.S.C. §119(e) to U.S. Provisional Patent Application Ser. No. 61/022,241, filed Jan. 18, 2008, the contents of which are incorporated by reference herein.

TECHNICAL FIELD OF THE DISCLOSURE

The present disclosure relates to a high performance grease compositions that provide good results in a journal bearing test or an oscillating stress level test. In an example embodiment, such a grease may include a primary calcium sulfonate thickener, and optionally, secondary thickeners, such as metal complex soap or non-soap grease thickeners, in combination with base oils and solid and oil soluble additive systems for lubricating journal bearing in a rock bit for subterranean drilling, such as a roller cone drill bit.

BACKGROUND OF THE DISCLOSURE

A wide variety of roller cone or rotary cone drill bits, which are a type of rock bit have been and are currently being used to form wellbores or boreholes in subterranean formations for oil, gas, geothermal stream, and the like. Roller cone drill bits generally include at least one support arm and often three support arms. A respective cone assembly may be rotatably mounted on a spindle or journal extending inwardly from an interior surface of each support arm. Although many specific examples in the current specification refer to roller cone drill bits, it is well-known that grease compositions usable in roller cone drill bits are often usable in other rock bits as well.

A cone assembly typically includes a cavity with a configuration and interior dimensions sized to receive exterior portions of an associated spindle therein. A wide variety of bearings, bearing assemblies or other supporting structures may be disposed between interior portions of the cavity of each cone assembly and exterior portions of an associated journal or spindle. Grease is filled into the cavity of this roller cone assembly to provide the lubrication required to separate the moving parts. Surface coatings (such as silver) are engineered onto the bearing surfaces to protect the surfaces. Fluid barriers include seal material or diaphragms. Seal material may include hydrogenated nitrile rubber (HNBR) and may be used to seal and prevent drilling mud from entering into the roller cone assembly.

Such a roller cone drill bit, during the downhole drilling, is subjected to severe operating conditions such as constant and repetitive shock loads exerted to the interior portions of bearing surfaces with pressure in excessive of 15 MPa and temperature above 150° C.

In order to sustain the useful life of such roller cone assembly including journals, bearings, seals and fluid barriers, and surface coating materials and subsequently extend the duration of the drilling operation, one uses a rock bit grease.

Grease is a semi-solid comprising base oil, additive, and thickener dispersed within to give the gel-like texture. Because greases do not flow readily, they are used where extended lubrication is required and where oil would not be retained. One such example is the soap grease that is formed by reacting (saponifying) a metallic hydroxide, or alkali, with a fat, fatty acid, or ester in the presence of base oil and necessary additives. The selection on the type of soap grease used depends on the grease properties desired. For instance, calcium (lime) soap greases are highly resistant to water, but unstable at high temperatures. Sodium soap greases are stable at high temperatures, but wash out in moist conditions. Lithium soap greases resist both heat and moisture. A complex soap grease is an improved version of soap grease that is formed by combining multiple sources of acids such as high-molecular-weight fat or fatty acid, short chain acid, dibasic acids, or inorganic acid, and the alike, in the grease manufacturing that results in the increase the dropping point of grease. Lithium, calcium, and aluminum greases are common alkalis in complex soap grease. Non-soap thickeners, such as clays, silica gels, carbon black, polyurea and various synthetic organic materials are also used in grease products. A mixed-base grease is a grease that utilizes different types of thickeners such as soap and non-soap thickener.

A suitable rock bit grease for roller cone bits typically fulfills a number of requirements. First, it may be capable of meeting lubrication requirements such as load carrying and wear reduction under the extreme high pressure and load conditions during subterranean drilling. Second, the grease may be compatible with fluid barriers and surface coatings to eliminate or reduce leakage and to maintain the integrity of the metal surface of the roller cone bits. Third, in downhole drilling, the pressure differential between the drilling well bore and the bit interior is usually carefully controlled regardless of the mud overhead placed on the drill bit. Maintaining this pressure differential within a specified limit ensures reliable performance of the primary seal in a drill bit. Any pressure variations received from the bore well ideally propagate through all internal bearing/seal components with minimal loss and time delay. The media responsible for transferring/propagating pressure signals as such is the grease. Accordingly, greases may be designed to exhibit rheological properties such as grease fluidity and consistency over the entire life and fast-changing operating environment of the demanding drilling operation.

Failures of the grease to deliver all of the functions mentioned above, namely, abilities to lubricate and reduce wear, seal and surface material compatibility, anti-corrosiveness, and adequate rheological responses, will result in the premature failures of the roller cone assembly and ultimately failures of the entire drilling operations which can not only cost dearly and significantly more than the cost of replacing defective parts but also consume precious time and energies to retrieve the failed bits and to resume drilling operations.

A wide variety of grease compositions have been employed and proposed in roller cone drill bit or rock bit applications. For instance, Smith U.S. Pat. No. 4,358,384 describes examples of greases for roller cone drill bits with a petroleum derived base stock and metal soap or metal complex thickener.

Calcium (Hughes Tool, U.S. Pat. No. 3,935,114) and Calcium complex greases (Dresser, U.S. Pat. No. 4,409,112) are known in arts to lubricate rock bit with good load carrying and wear reducing properties.

Smith U.S. Pat. No. 5,668,092 discloses high viscosity base oils in thickener such as silica, which are claimed to have excellent film strength in lubrication.

Baker Hughes U.S. Pat. No. 5,891,830 discloses Calcium complex synlubes, which are claimed to have improved lubrication and thermal stabilities.

Tomlin Scientific U.S. Pat. No. 7,312,185 discloses the use of high-viscosity poly-alpha-olefin (PAO) and other synthetics such as alkylated naphthalene to enhance the thermal stability of the grease.

Despite these advances, the lubricating greases for roller cone drill bits have focused primarily on the improved lubrication through the use of novel extreme pressure (EP) additives, and enhanced thermal abilities through the use of synthetic base oils. Further advances are needed that address rheological aspects of greases that can be beneficial to the operation of the roller cone drill bits. In particular advances over traditional complex soap grease and/or non-soap thickener systems such as silica are needed. In particular, greases with even higher stability, enhanced lubrication, improved compatibility with fluid barriers and surface materials, and/or improved anti-corrosion properties as well as improvements in rheological properties such as the ability to transfer pressure signals over the entire drilling operation are needed. Improvements in all or several of the above properties will enhance the durability and the life of the roller cone drill bits.

One aspect of current disclosure relates to greases with such improvements. Particular examples relate to greases containing sulfonates. Sulfonate greases are known to provide outstanding mechanical, anti-corrosion, and good inherent load carrying properties that are related to the calcite or micelle like structure of the grease (see e.g. U.S. Pat. No. 4,560,489 of Witco Chem. Corp.; U.S. Pat. No. 5,126,062 of NHC Corp.; Matthew Sivik and Bill Ward, The Lubrizol Corporation, "Understanding Calcium Sulfonate Thickeners," *Machinery Lubrication Magazine*, July 2006). A weld load of 400 kgf or even higher determined by four-ball weld bench test is common with calcium sulfonate grease. Calcium sulfonate grease was also noted as having a higher dropping point than those greases based on traditional complex soap grease thickeners.

U.S. Pat. No. 7,294,608 of Jet-Lube discloses calcium sulfonate greases as the threading compounds for oil field applications that operate in contact with drilling mud. These greases are claimed to have significantly improved resistance toward corrosion, erosion, ablation benefits and protection of threaded connection surfaces.

These calcium sulfonate greases are untested in roller cone drill bits or in conditions roller cone drill bits are likely to encounter, or these greases leave additional room for improvement in one or more grease properties discussed above.

SUMMARY OF THE DISCLOSURE

It is, therefore, the objective of embodiments of the present disclosure to provide novel grease compositions that are superior not only in the areas of improved load carrying and wear protection for rock bit applications with ever-increasing severity, but also in enhanced thermal stability and rheological/structural characteristics that make the grease more suitable as an effective and reliable pressure sensing media upon extended usage. These improvements discussed above may be measured using a journal bearing test and/or an oscillating stress level test. In further embodiments the grease compositions may also exhibit additional improvements such as a reduced tendency to impair seal performance or degrade surface coatings. In still further embodiments, the grease may be non-toxic.

One embodiment of the present disclosure relates to a grease containing a metal sulfonate thickener, such as a calcium sulfonate thickener, a base oil including a mineral oil, a synthetic oil, and combinations thereof, at least one solid additive including graphite, polytetrafluoroethylene, silica, inorganic sulfur-containing solids, inorganic phosphorus-containing solids, inorganic boron-containing solids, and any combinations thereof, and at least one oil-soluble additive including extreme pressure (EP) additives, oxidation inhibitors, wear and friction reducing additives, polymer additives for enhanced grease integrity, pour point depressant, or corrosion inhibitor, and any combinations thereof.

In another embodiment, the grease may include a second thickener such as a metal complex soap grease, or a non-soap thickener, such as an inorganic non-soap thickener.

In still another embodiment, the disclosure relates to a roller cone drill bit containing a grease of the present disclosure.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION

Figure 1:
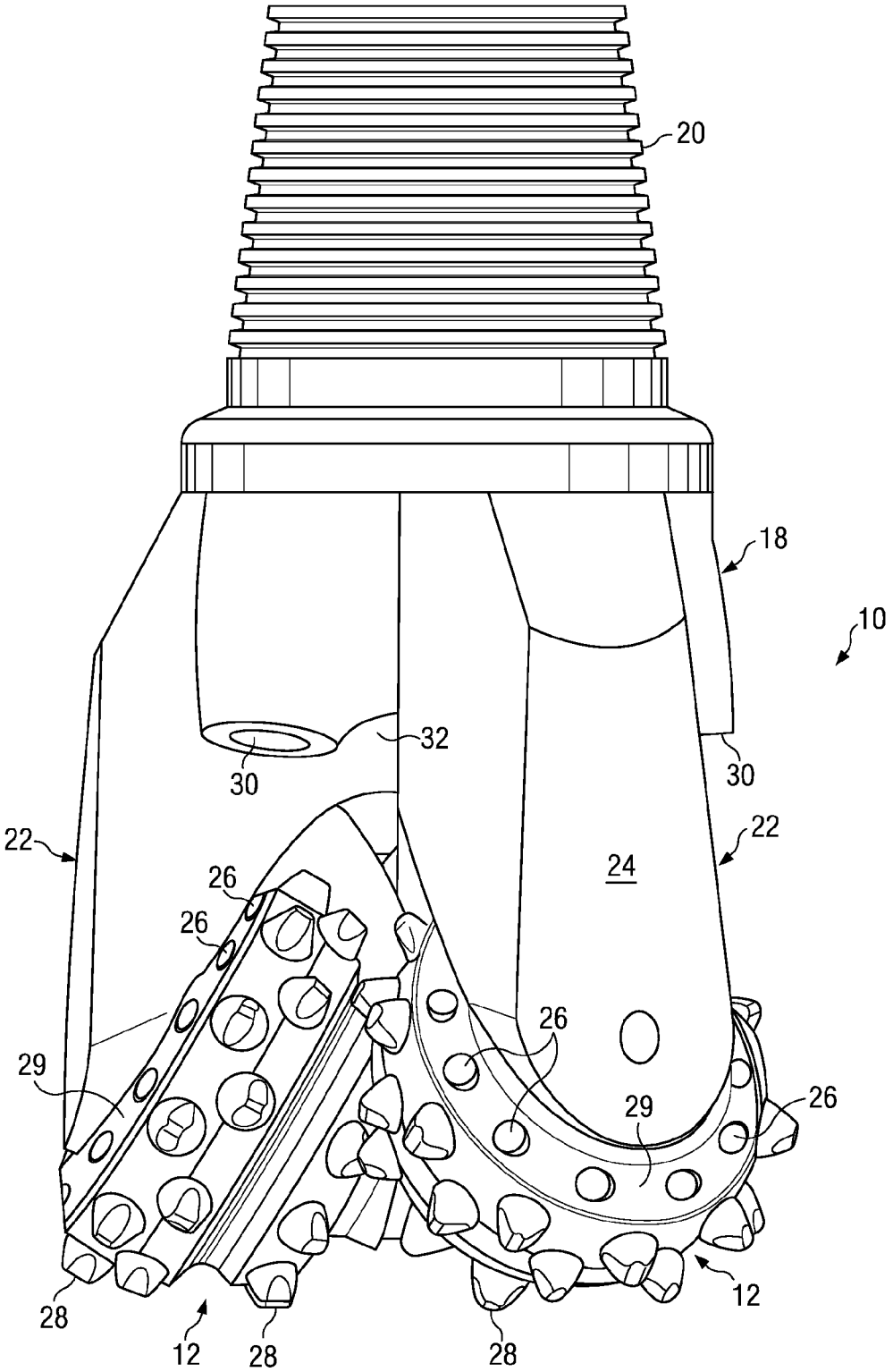
FIG. 1 is a schematic drawing showing an isometric view of one example of a roller cone drill bit.

The following defined terms may be used throughout this specification. Unless contradictory to the definitions set forth herein, knowledge of one of ordinary skill in the art may be used to supplement these definitions.

The terms "cutting element" and "cutting elements" may be used in this specification to include various types of compacts, inserts, milled teeth and welded compacts satisfactory for use with roller cone drill bits. The terms "cutting structure" and "cutting structures" may be used in this specification to include various combinations and arrangements of cutting elements formed on or attached to one or more cone assemblies of a roller cone drill bit.

The terms "cone assembly" and "cone assemblies" may be used in this specification to refer to a wide variety of "rotary cone cutters", "roller cone cutters", "rotary cutter assemblies" and "cutter cone assemblies."

The terms "grease," "greases," and "grease composition" as used in this specification shall mean any grease, composite, or mixed-base grease or any other mixture of fluids and solids formed in accordance with teachings of the present disclosure. The grease, in certain embodiments, may include calcium sulfonate.

The terms "composite grease," shall mean any grease mixture or composition that was prepared by blending/mixing any base grease containing one or more thickeners with additives and base oils to give the grease properties and performance features that may be desired The term "complex soap or complex grease" as used refers to a grease material containing a mixture of soap thickeners derived from fats, fatty acids, high and low molecular acids, or inorganic acids.

Performance of greases of the present disclosure in the areas of lubrication and wear reduction abilities, fluid barrier and surface material compatibility, non-toxicity, and anti-corrosiveness, may be assessed using tests known in the art. Such tests include, but are not limited to American Society for Testing and Materials (ASTM) D6081 "Aquatic Toxicity Testing of Lubricants: Sample Preparation and Report Interpretation," ASTM D4048 "Detection of Copper Corrosion from Lubricating Grease," ASTM D2266 "Wear Prevention Characterization of Lubricating Grease," ASTM D3704 "Wear Prevention Properties of Lubricating Grease Using The Falex Block on Ring Test Method," ASTM D2596 "Measurement of Extreme-Pressure Properties of Lubricating Grease (Four Ball Method), ASTM D2782 "Measurement of Extreme-Pressure Properties of Lubricating Grease (Timken Method)." Each of these tests is incorporated in material part by reference herein.

Rheology and structural characteristics of the greases may be assessed using known tests as well as the journal bearing test disclosed herein and the oscillating stress level test disclosed herein. Suitable greases may pass the journal bearing test at least once, at least 33% of the time, at least 66% of the time, or approximately 100% of the time. Suitable greases may also exhibit an initial flow point of at least 150 Pa in the oscillating stress level test and/or a flow point of at least 100 Pa in the oscillating stress level test after thermal ageing. Alternatively suitable greases may also exhibit an initial flow point of at least 247 Pa in oscillating stress level test and/or a flow point of at least 240 Pa in the oscillating stress level test after thermal aging. The change in flow point after thermal aging reflects the performance of a grease in downhole conditions over time. Accordingly, greases of the present disclosure may exhibit a change in flow point of no more than one order of magnitude before and after thermal aging. Some greases may exhibit a change in flow point of zero orders of magnitude before and after thermal again. Greases of the present disclosure may also be tested for reduced harm to fluid barriers, such as seals and diaphragms, and surface coatings and for improved transmission of pressure from outside of the bit to internal regions. For example, damage to fluid barriers may be detected using ASTM D1546 "Elastomer Compatibility of Lubricating Greases and Fluids," incorporated in material part by reference herein. Damage to surface coatings may be detected in bearing tests. These and other tests may be designed to be specific for grease used in roller cone drill bits as opposed to more general tests or tests for greases used in other applications, such as thread greases.

Greases of the present disclosure may be able to satisfactorily reduce friction between bearing surfaces associated with a roller cone drill bit operating at temperatures significantly above 150° C.

One embodiment of the present disclosure accordingly relates to a grease composition including:

1) A primary metal sulfonate thickener, and optionally, secondary thickeners, in minor proportion, of a metal complex soap grease type or a compatible non-soap type thickening agent; and
2) Base oil(s) selected from synthetic, mineral, or a mixture of mineral oil and synthetic oil—functioning as base oil medium, diluent, or additive solubilizer;
3) Solid additive(s); and
4) Oil-soluble additive(s).

The primary metal and a base oil may be formulated into a "base grease." Generally, a "base grease" as used herein may be any grease combination absent the solid and oil-soluble additives.

The base grease, entire grease composition, or portions of the grease composition may be formed in essentially a single step during which all or essentially all thickeners and additives (if applicable) are added.

Alternatively, the base grease, entire grease composition, or portions of the grease composition may be formed by mixing one or more base greases, grease compositions, or portions of grease compositions, each with a different thickening agent or combination of thickening agents. For example, the base grease may be formed by preparing a first base grease with the primary thickener and preparing a second base grease with one or more secondary thickeners, then mixing these two base greases. Alternatively, the grease composition may be formed by preparing a first grease composition with the primary thickener and additives and preparing a second grease composition with one or more secondary thickeners, then mixing these two grease compositions to form the final grease composition.

One of ordinary skill in the art may readily determine whether a grease prepared by one method may also be prepared by a different method by simply mixing the same grease components by the different method.

For example, grease compositions of the present disclosure may be made using a multi-step approach by first mixing/blending a metal sulfonate base grease and metal complex soap grease base grease that may be prepared individually or purchased commercially. Additives and additional base oil components may be later added to this base grease mixture to achieve the optimal grease consistency. Promoters such as water, acids, or alcohols, overbasing agents such as calcium hydroxide, lime or the like, and additional promoters may be added as desired.

Alternatively, the grease compositions may also be made via a one-step synthesis, as may be exemplified in Example 5 and also in U.S. Pat. No. 6,875,731, U.S. Pat. No. 5,338,467, or Papke, *Tribology Transaction*, Vol. 31, pp. 420-426, each incorporated by reference herein. Generally, the one-step synthesis may proceed by charging a grease kettle with thickeners made up of sulfonate base acids such as heavy alkylbenzene sulfonic acids or dodecyl sulfonic acid, and complex soap grease base acids such as fatty acids or the like, aliphatic or aromatic acids or the like (e.g. C8-C22 fatty acids, 12-hydroxy stearic acid, 2-ethylhexanoic acid, hexanoic acid, acetic acid, and phthalic acid), in a weight ratio proportional to the base grease weight ratios described below. Overbasing agents such as, calcium hydroxide, lime, or the like and promoters such as water or alcohols, or the like may also be added at essentially the same time, followed by the addition of additives and additional base oils, if needed.

In general, the thickener provides the overall three-dimensional structure of the grease. The primary thickener may be a metal sulfonate thickener such as a sodium, magnesium, barium or calcium sulfonate. The sulfonate thickener may have micelle structure. For example, the sulfonate thickener may contain a carbonate core surrounded by sulfonates to form a micelle structure. A base grease containing such a thickener may be referred to as a "metal sulfonate base grease" or a "metal sulfonate complex base grease."

In a specific embodiment, the primary thickener may be calcium sulfonate and the base grease formed using it may sometimes be referred to as "calcium sulfonate base grease", or "calcium sulfonate complex base grease" and may be commercially available from grease manufacturers such as Chemtura Corporation (Middlebury, Conn.) and the like. Calcium and barium-sulfonate greases and sulfonate-complex greases are also available from Chemtura Corp. (e.g. G-2184), Shell Corp. (Houston, Tex.) (e.g. SRS 2000), and Chevron Corp. (San Ramon, Calif.).

The calcium sulfonate base grease may be prepared by converting overbased sulfonates with a total base number (TBN) up to 450 (for example, the overbased sulfonates may have a TBN of at least 300, 300 to 450, at least 400, and 400 to 450), in the presence of promoters or co-reactants such as carboxylic acids of C8 up to C18 carbon chain length, and appropriate base oils or diluents, into crystalline or micelle structures in the presence of appropriate medias such as synthetic or mineral oils. Such processes may be carried out according to the teachings U.S. Pat. No. 4,560,489 and U.S. Pat. No. 5,126,062, both incorporated in material part by reference herein.

In one embodiment, the overbased sulfonate used in the preparation of calcium sulfonate thickener may be obtained by neutralizing and overbasing sulfonic acid derived from petroleum or synthetic based raw materials such as dodecyl benzenes, or di-dodecyl benzenes, or other alkyl benzene of the alike, with lime or calcium hydroxide. Overbased sulfonates are abundantly available from various commercial sources such as Chemtura Corporation (Middlebury, Conn.), Lubrizol Corporation (Wickliffe, Ohio), Pilot Chemical Co. (Cincinnati, Ohio) and other grease manufacturers. Calcium sulfonate may, for example, include a fluid detergent containing crystalline calcium carbonate. The calcium sulfonate base grease may have a micelle-like soap structure.

The secondary thickener may be made of traditional metal complex soap grease or non-soap thickener and the base grease formed using it may sometimes be referred to as the "second base grease." Such greases may be commercially available from many grease manufacturers including Benz Oil Corporation (Milwaukee, Wis.) (e.g. WR500), ExxonMobil Corporation (Irving, Tex.) (e.g. Greasrex 47), and Jet-Lube, Inc. (Houston, Tex.).

There are numerous examples of second base greases in the art that can be made with either metal complex soap grease, detergents, or non-soap thickeners. Metal complex soap greases are typically aluminum-, lithium-, or alkaline earth metal (e.g. calcium, barium, or magnesium) salt-based, for instance, as disclosed by Texaco in U.S. Pat. No. 3,907,692 (incorporated in material part by reference herein). Non-soap greases containing silica or other types of thickening agents may be used if compatible with the first base grease, particularly a calcium sulfonate grease. Non-soap thickeners include, but are not limited to clays, silica gels, carbon black, polyurea and various synthetic organic materials. In one specific embodiment, the second base grease may be a calcium complex soap grease. Compatibility of the first and second base greases may be determined using tests know to those of ordinary skill in the art. For example, one such test is ASTM D6185 "Standard Practice for Evaluating Compatibility of Binary Mixtures of Lubricating Greases," incorporated in material part by reference herein.

The relative amounts of sulfonate thickener versus the second thickener in the composite grease may vary. For example, the composite grease may be selected to contain metal sulfonate thickener with approximately 90%, 95% or 100% by weight of the total thickener content for increased performance in the journal bearing test and the oscillating stress level test. Alternatively, an acceptable composite grease may contain approximately 40% metal sulfonate thickener of the total thickener content by weight. In a particular embodiment, the composite grease may contain between approximately 70% metal sulfonate thickener by weight of the total thickener content and approximately 100% metal sulfonate thickener by weight. Lower amounts of metal sulfonate thickener, such as approximately at least 20%, at least 30%, or at least 40% by weight may be acceptable provided that the overall composite grease after additives are included demonstrates acceptable journal bearing test and/or oscillating stress level test results. Although the above percentages are provided for composite greases, one of ordinary skill in the art will appreciate that the base greases, which may a be completed or partially completed with solid and oil-soluble additives to form composite greases, may contain similar thickener proportions. Similarly, as described above, in other methods of mixing the grease composition, the primary thickener and secondary thickener may be provided in similar weight ratios. So, for example, embodiments of the current disclosure also include grease compositions containing approximately 90%, 95% or 100% metal sulfonate thickener by weight. Embodiments of the current disclose also include grease compositions containing thickeners wherein approximately 90%, 95% or 100% of the total thickener by weight is a metal sulfonate.

Further, although use of only one second base grease is specifically discussed in this specification, there is no limit on the number of additional base greases that may be used in combination with the metal sulfonate base grease. For example, the composite grease may contain approximately 40% by weight metal sulfonate thickener with the remainder of the grease made up of two or more different secondary thickeners.

Base oils may be added to some grease compositions of the current disclosure in a variety of ways. For example, the base oils may be mixed with the thickener to form a base grease, they may be added to a base grease, they may be used to carry and add additives, and they may be used for one or more of these different functions in the same grease composition. The same base oil may be employed for all of these uses or different base oils may be used. Further, more than one base oil may be used for the same function. For example, a base grease may be formed using a thickener and two different base oils.

Base oils that may be used in the present disclosure may include synthetic or mineral oil, or a mixture of synthetic and mineral oils. Base oils may be high viscosity oils that typically have a viscosity range from 22 cSt at 40° C. to 1,000 cSt at 40° C. or even higher. Synthetic oils include, but are not limited to, poly-alpha-olefin (PAO) (e.g. SpectraSyn Ultra™ and PureSyn™ available from ExxonMobil Chemical (Irving, Tex.), or LUCANT™ available from Mitsui Chemicals America (Rye Brook, N.Y.)), ethylene and alpha olefin co-oligomers (such as those available from Mitsui Chemicals America), and other hydrocarbon fluids such as Polyisobutylene (PIB), alkylated aromatics (e.g. KR-010 available from King Industries (Norwalk, Conn.) such as alkylbenzene (AB) and alkyl naphthalene (AN) (such as available from King Industries). Mineral oils include, but are not limited to, base oils made via gas to liquid (GTL), hydro-cracked or hydro-processed oils of Group II and III types, and paraffinic oils and naphthenic oils from 100 N to bright stock made via solvent refined processes.

The use of synthetic oil provides enhanced stability and low temperature properties but also adds up to the cost of the final grease. Mineral base oils are found generally satisfactory despite their somewhat lower stability and higher low temperature properties such as pour point. The lower stability can be improved by the addition of antioxidant, and the low temperature flow properties of the base oil can be overcome by the use of pour point depressant. Mineral oils may also suffer from limited availability of higher viscosity range stocks. To overcome this, a combination of synthetic and mineral oil can be used effectively to achieve high viscosities such as above 1,000 cSt at 40° C., or even higher.

A plethora of additives, solid, liquid, oil-soluble, or oil-insoluble have been previously proposed or used in rock bit drilling. Without exception, any and all of these additives can be unmixed or mixed or blended in the composite grease compositions of the present disclosure.

In another embodiment, the solid additives may be metal sulfides such as $MoS_2$, friction reducing solids such as graphite or polytetrafluoroethylene (PTFE), silica, inorganic sulfur-, phosphorus-, or boron-containing solids, titanium, and zirconium. Titanium may be present in the secondary thickener as well.

The oil soluble additives may be selected from at least one of the categories of 1) extreme pressure (EP) additives, 2) oxidation inhibitors, 3) wear and friction reducing additives, 4) polymer additives for enhanced grease integrity, 5) pour point depressants, and 6) corrosion inhibitors (CI).

In a specific embodiment, EP additives also sometimes referred to as "load carrying additives," and wear and friction-reducing additives may include metal based (ash-containing) additives that are known to be capable of forming a tribochemical film upon load, pressure, or temperatures, such as salts of zinc, antimony, bismuth, molybdenum, non-metal (ashless) additives such as sulfur, phosphorus, or halogen-containing derivatives such as sulfur/nitrogen (S/N) containing heterocyclic compounds such as thiadiazole derivatives (e.g. Vanlube 829 available from RT Vanderbilt Company, Inc. (Norwalk, Conn.)), or others that will interact or react strongly with metal surfaces. Other specific examples include aliphatic or aromatic phosphate such as Desilube 77 available from Desilube Technology (Landsdale, Pa.), dialkyl di- or tri-sulfides such as TPS 20 available from Arkema, Inc. (Philadelphia, Pa.), or ashless or metal containing dithiocarbamate such as Molyvan A, Vanlube 73 available from RT Vanderbilt, or dithiphosphate such as LZ677A available from Lubrizol, and the like.

Example oxidation inhibitors include, but are not limited to hindered phenols, (e.g. butylated hydroxyl toluene (BHT)), aryl amines (e.g. Vanlube 81 available from RT Vanderbilt), polymerized, nitrogen-containing heterocycles, (e.g. Vanlube RD available from RT Vanderbilt), and the like.

Example polymer additives for enhanced grease integrity include, but are not limited to olefin copolymers (OCP) such as Shellvis polymers, LZ 7077D available from Lubrizol, styrene derivatives such as Shellvis 150 available from Infineum USA LP (Linden, N.J.), isobutylene polymers such as H-1500 available from Innovene (INEOS Group, Hamphshire, UK), or V-422 from Functional Products, Inc. (Macedonia, Ohio), and the like.

Example pour point depressants include, but are not limited to polyalkylmethacrylates, styrene ester polymers, alkylated naphthalenes, ethylene Vinyl acetate copolymers, and polyfumarates.

Example corrosion inhibitors, also called metal passivators, include, but are not limited to compositions to suppress copper-silver corrosion, organic nitrogen, and sulfur-containing compounds. In specific embodiments, the metal deactivator or passivator may include mercaptobenzothiazole (MET), trizaole, 2,5-Dimercapto-1,3,4-thiadiazole (DMTD) or derivatives thereof.

Figure 2:
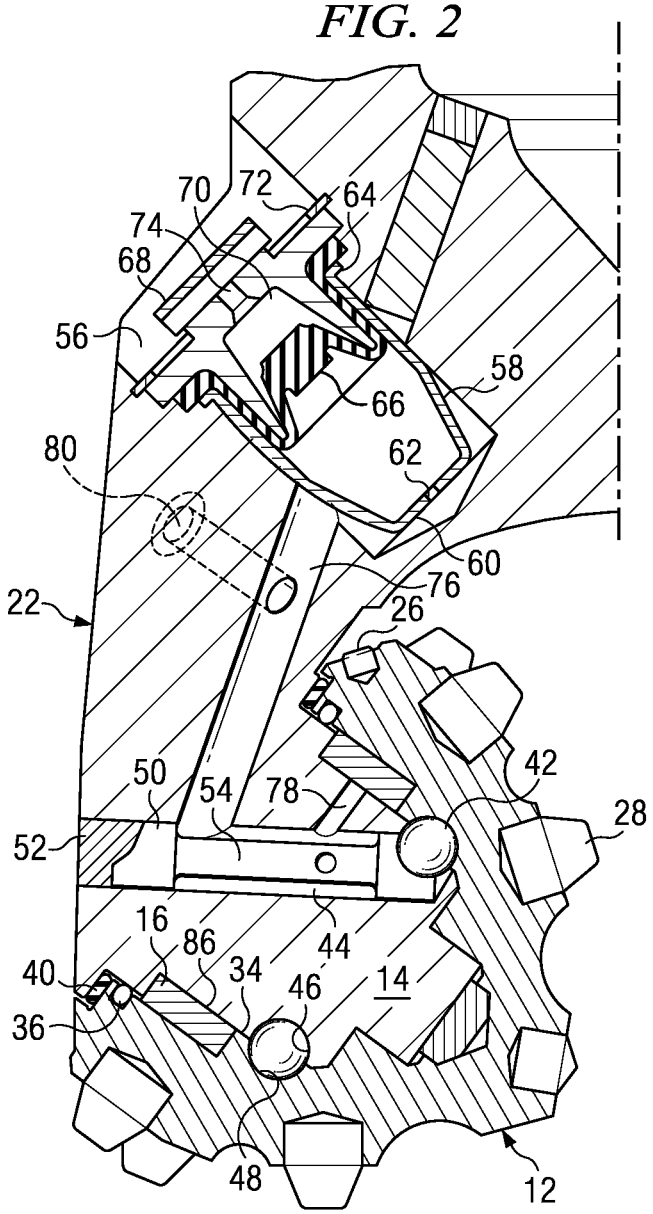
FIG. 2 is a schematic drawing in section with portions broken away showing a support arm, cone assembly and lubrication system associated with the drill bit of FIG. 1.
Figure 3:
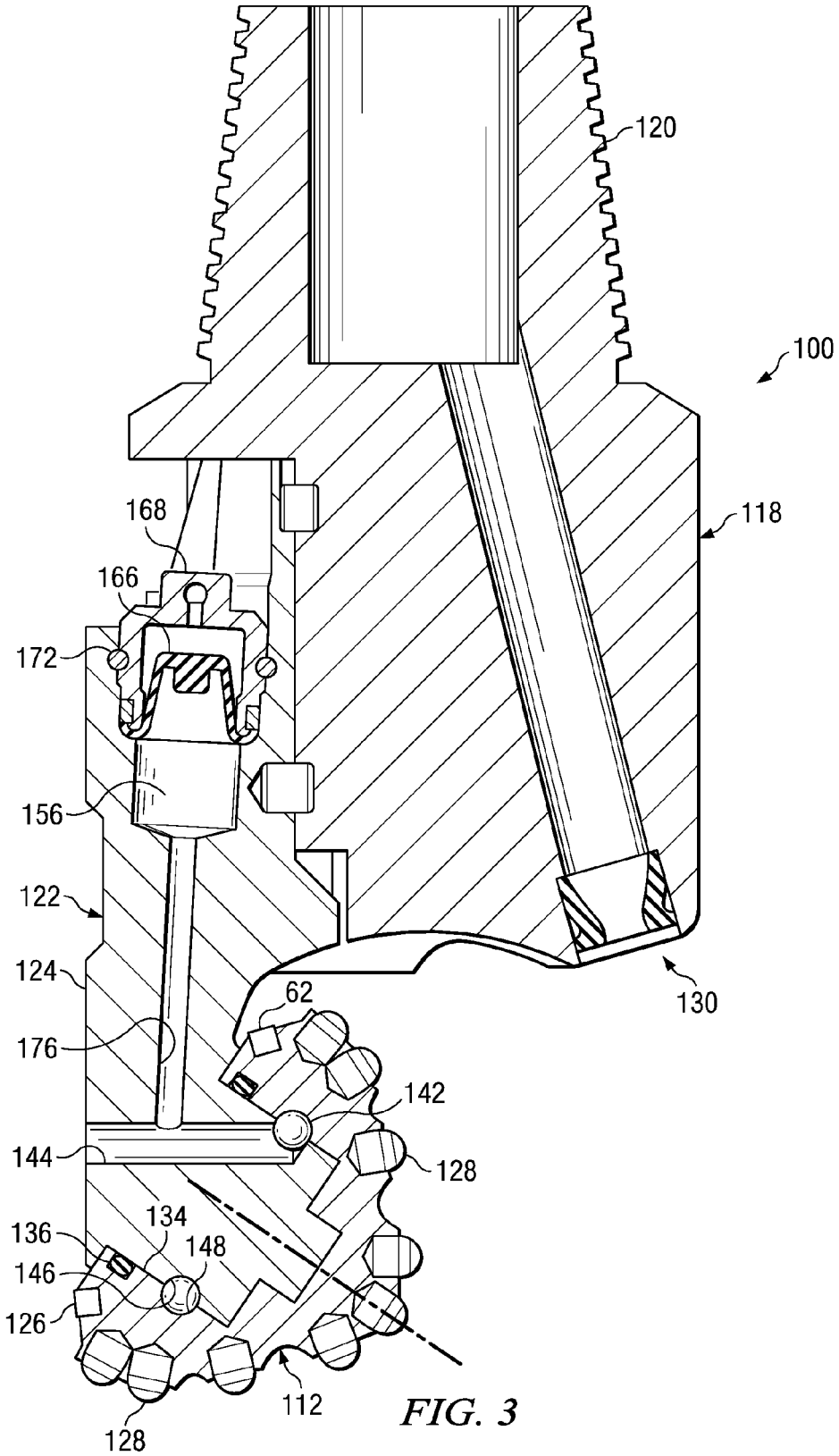
FIG. 3 is a schematic drawing in section with portions broken away showing another example of a rotary cone drill bit having at least one support arm, cone assembly and associated grease system.

Various features of the present disclosure may be described with respect to rotary cone drill bits, support arms, cone assemblies and/or grease systems such as shown in FIGS. 1-3. However, greases incorporating teachings of the present disclosure may be used with a wide variety of roller cone drill bits and rotary cone drill bits. The present disclosure is not limited to rotary cone drill bits, support arms, cone assemblies and/or grease systems as shown in FIGS. 1-3.

Drill bit 10 may include a grease cavity 56 which is open to exterior portions of drill bit 10 (not shown in FIG. 1). Grease cavity 56 may include a grease reservoir defined in party by grease container 58 disposed within grease cavity 56. Grease container 58 may include end 60 with opening 62 disposed therein.

The opposite end of grease container 58 may include flanged shoulder 64 supporting flexible resilient diaphragm 66 that closes grease container 58. Cap 68 may cover diaphragm 66 and define chamber 70 facing diaphragm 66. Cap 68, diaphragm 66 and grease container 58 may be retained within grease cavity 56 by snap ring 72. Cap 68 may also include opening 74 to allow communication of external fluid pressure surrounding drill bit 10 with exterior portions of diaphragm 66. The volume between diaphragm 66 and end 60 of grease container 58 may be filled with the grease of the present disclosure to lubricate associated bearing 16 and ball bearings 42.

Grease passage 76 may extend through support arm 22 to place grease cavity 56 in fluid communication with ball passage 44. Grease passage 76 may communicate with one end of grease cavity 56 generally adjacent grease opening 62 and grease container 58.

Ball passage 44 may be placed in fluid communication with internal cavity 34 by conduit 78. Upon assembly of drill bit 10, grease passage 76, grease container 58, grease cavity 56, available space in the ball plug passage 44, conduit 78 and available space in internal cavity 34 may be filled with grease incorporating teachings of the present disclosure through opening 80 in support arm 22. Opening 80 may be subsequently sealed after grease filling.

The pressure of fluids surrounding exterior portions of drill bit 10 may be transmitted to grease disposed in grease container 58 by flexing of diaphragm 66. Such flexing of diaphragm 66 maintains the grease at a pressure generally equal to the pressure of the external fluids outside drill bit 10. This pressure may be transmitted through grease passage 76, ball passage 44, conduit 78 and internal cavity 34 to the inner face of elastomeric seal 36. As a result elastomeric seal 36 may be exposed to an internal pressure from the grease generally equal to the pressure of the external fluids.

FIG. 3 is a schematic drawing showing another example of a rotary cone drill bit which may have one or more lubrication systems filled with grease formed in part by a calcium sulfonate thickener incorporating teachings of the present disclosure. Rotary cone drill bit 100 may have three support arms 122 with respective cone assemblies 112 rotatably mounted thereon.

Only one support arm 122 and associated cone assembly 112 is shown in FIG. 3. Drill bit 100 may include one piece or unitary bit body 106. The dimensions of concave exterior surface 110 and the location of cone assemblies 112 may be selected to optimize fluid flow between lower portions 108 of bit body 106.

Cone assemblies 112 of drill bit 100 may be mounted on journal or spindle 114 projecting from respective support arms 102. Each cone assembly 112 may include generally cylindrical cavity 134 sized to receive exterior portions of spindle or journal 114 therein. Each cone assembly 112 and respective spindle 114 may include longitudinal axis 116 which also represents the axis of rotation for each cone assembly 112 relative to its associated spindle 114. Each cone assembly 112 may be retained on its respective journal 114 by a plurality of ball bearings 142. Ball bearings 142 are inserted through opening 120 in exterior surface of support arm 122 and ball retainer passageway 144 of the associated support arm 122. Ball races 146 and 148 may be formed in interior of cavity 134 of the associated cone assembly 112 and the exterior of journal 114.

Ball retainer passageway 144 may communicate connected with ball races 146 and 148 such that ball bearings 142 may be inserted there through to form an annular array within ball races 146, 148 to prevent disengagement of each cone assembly 112 from associated journal 114. Ball retainer passageway 144 is subsequently plugged by inserting a ball plug retainer (not expressly shown) therein. A ball plug weld (not expressly shown) may be formed within each opening 120 to provide a fluid barrier between ball retainer passageway 144 and the exterior of each support arm 122 to prevent contamination and loss of grease from the associated lubrication system.

Each support arm 102 preferably includes grease cavity or grease reservoir 156 having a generally cylindrical configuration. Grease cap 168 may be disposed within one end of grease cavity 156 to prevent undesired fluid communication between grease cavity 134 and the exterior of support arm 102. Grease cap 168 may include flexible, resilient diaphragm 160 that closes grease cavity 156. Cap 168 may cover diaphragm 166 and define in part chamber 136 which provides a volume into which diaphragm 166 may expand. Cap 168 and diaphragm 166 may be secured within grease cavity 156 by retainer ring 172.

Grease passage 176 may extend through support arm 122 to allow grease cavity 156 to communicate fluid with ball retainer passageway 144. Ball retainer passageway 144 provides fluid communication with internal cavity 134 of associated cone assembly 112 and bearings disposed between exterior portions of spindle 114 and interior portions of cavity 134. Upon assembly of drill bit 100, grease passage 176, grease cavity 156, any available space between the interior surface of cavity 134 and exterior of spindle 144 may be filled with grease incorporating teachings of the present disclosure through an opening (not pictured) in each support arm 102.

The pressure of fluids around the exterior of drill bit 100 may be transmitted to grease contained in grease cavity 156 by diaphragm 166. Flexing of diaphragm 166 maintains the grease at a pressure generally equal to the pressure of fluids around the exterior of drill bit 100. Grease pressure is transmitted through grease passage 176, ball retainer passageway 144 and internal cavity 134 to expose an inward face of seal element 176 to pressure generally equal to the pressure around the exterior of drill bit 100.

Seal element 136 may be positioned within a seal retaining groove within cavity 134 to establish a fluid barrier between adjacent portions of cavity 134 and journal 114. Seal element 136, may be an o-ring seal, a t-seal, a v-seal, a flat seal, a lip seal or any other seal operable to establish a fluid barrier between adjacent portions of cavity 134 and journal 114. In addition, more than one seal or a combination of seal and backup ring may be positioned within one or more seal retaining grooves or otherwise between cavity 134 and journal 114.

EXAMPLES

The present disclosure may be better understood through reference to the following examples. These examples are included to describe exemplary embodiments only and should not be interpreted to encompass the entire breadth of the invention.

Example 1

Calcium Sulfonate Greases and Comparative Calcium Complex Grease

In the first step calcium sulfonate base grease was prepared by converting overbased sulfonates with a TBN of up to 450 into a crystalline or micelle structure with desired grease consistency in appropriate media as outlined in Table 1A. In the second step, solid and oil-soluble additives as described in Table 1B were added to this base grease.

TABLE 1A

Typical Formulation Ranges for Calcium Sulfonate Greases 1-3

| Item | Typical Ingredient | Formulation Range (wt %) Min | Max |
|---|---|---|---|
| 1 | PAO and/or mineral base oil | 5 | 60 |
| 2 | High TBN Calcium sulfonate | 5 | 70 |
| 3 | Dodecyl Benzene Sulfonate | 0 | 10 |
| 4 | Hydrated Lime | 0 | 10 |
| 5 | Boric, sulfuric, or phosphoric acid | 0 | 10 |
| 6 | Monobasic or Dibasic Acids of C8-C18 Carbons | 0 | 10 |

TABLE 1B

Additives Used in the Finished Greases of Calcium Sulfonate Greases 1-3 and Comparative Example 1

| Item | Additive Category | Example | Formulation Range (wt %) Min | Max |
|---|---|---|---|---|
| 1 | Solid Additive | $MoS_2$ | 2 | 20 |
| 2 | Oil Soluble EP | Molyvan A | 0.1 | 10 |
| 3 | EP/CI | Vanlube 829 | 0.1 | 10 |
| 4 | Polymer Additive | INDOPOL H-1500 | 1 | 20 |
| 5 | Base Grease | | Balance up to 99% | |

Calcium Sulfonate Grease 1

A 150 TBN and PAO-based calcium sulfonate complex base grease was sourced commercially with a sulfonate thickener content estimated at 20-25 wt % and a calcium content of 6.5 wt %. This base grease was confirmed to exhibit calcite structure with a characteristic IR peak at 880+/−10 $cm^{-1}$, and was tested to give a four-ball weld load of 400 kgf.

72 wt % of the above calcium sulfonate complex base grease, 4 wt % of diluent oil, and a total of 28 wt % base oil and additives package were mixed in a blend vessel at ambient temperature, and heated with stirring to a temperature of no more than 90° C. until a uniform grease composition was achieved. The base oil and additive package (total 28 wt %) includes 4 wt % of base oil, 9 wt % inorganic solids, 11 wt % isobutylene polymers, 1 wt % organic Molybdenum dithiocarbamate additive, and 3 wt % thiadiazole based extreme pressure additive.

Calcium Sulfonate Grease 2

A 130 TBN and mineral oil-based calcium sulfonate complex grease was sourced commercially with a sulfonate thickener content estimated at 20-25 wt % and a calcium content of 6 wt %. This base grease was confirmed to exhibit calcite structure with a characteristic IR peak at 880+/−10 $cm^{-1}$, and was tested to give a four-ball weld load of 315 kgf. 72 wt % of the above base grease and the same 28 wt % base oil and additive package were mixed in a blend vessel at ambient temperature, and heated with stirring to a temperature of no more than 90° C. until a uniform grease composition was achieved. The same base oil and additive package as in Calcium Sulfonate Grease 1 was used.

TABLE 1C

| Typical Formulation Ranges for the Calcium Complex soap Grease Base Grease used in Comparative Example 1 | | | |
|---|---|---|---|
| | | Formulation Range (wt %) | |
| Item | Typical Ingredient | Min | Max |
| 1 | PAO and/or mineral base oil | 20 | 60 |
| 2 | Calcium hydroxide | 2 | 20 |
| 3 | Acetic acid | 3 | 30 |
| 4 | Monobasic or dibasic acids of C8-C18 Carbons | 0 | 20 |
| 5 | Triglyceride | 0 | 20 |

Comparative Example 1

A 120 TBN mineral oil-based calcium complex grease was sourced commercially with an estimated 30-35 wt % complex base thickener and a calcium content of 5.3 wt %. This base grease contained no 880 $cm^{-1}$ IR peak, indicating a lack of calcite structure, and was tested to give a four-ball weld load of 315 kgf. 72 wt % of the above base grease and the same 28 wt % base oil and additive package were mixed in a blend vessel at ambient temperature, and heated with stirring up to a temperature of no more than 90° C. until a uniform grease composition was achieved. The base oil and additive package was the same as in Calcium Sulfonate Grease 1.

Calcium Sulfonate Grease 3

A mixed-base grease was made by combining the base grease of Calcium Sulfonate Grease 2 and the base grease of Comparative Example 1 in a one to one weight ratio. This gives approximately a 2/3 ratio of sulfonate/complex thickener, or 40% by weight of sulfonate thickener. 72 wt % of the mixed-base base grease and the same 28 wt % base oil and additive package were mixed in a blend vessel at ambient temperature, and heated with stirring to a temperature of no more than 90° C. until a uniform grease composition was achieved. The base oil and additive package was the same as in Calcium Sulfonate Grease 1.

Calcium Sulfonate Grease 4

A fourth calcium sulfonate grease was made using the components listed in Table 2.

TABLE 2

| Calcium Sulfonate Grease 4 | | | |
|---|---|---|---|
| Company | Ingredient Name | Ingredient Function | Percent by Weight of One Composite Grease |
| Various | Calcium sulfonate grease | Base grease | 35.0 |
| ExxonMobil | Americas Core 2500 | Oil used to solubilize EP additive | 8.5 |
| R.T Vanderbilt | MOLYVAN L | Friction modifier or friction reducer | 3.2 |
| R.T Vanderbilt | VANLUBE 829 | Exteme pressure (EP) additive | 7.0 |
| Climax Molybdenum Company | Molybdenum disulfide | Extreme pressure (EP) additive | 6.2 |
| Afton Chemical | HiTEC 350 | Pour point depressant | 3.5 |
| Innovene USA | INDOPOL H-300 | Synthetic polybutene | 10.0 |
| Innovene USA | INDOPOL H-1500 | Synthetic polybutene | 23.0 |
| OMG Americas | Catalysts 320 | Extreme pressure (EP) additive | 1.5 |
| Cabot | CAB-O-SIL | Thickening agent | 1.7 |

This calcium sulfonate grease did not soften as readily as Calcium Sulfonate Greases 1-3. Further, while the grease compositions of Calcium Sulfonate Greases 1-3 exhibited four-ball weld loads of 800 kgf (Calcium Sulfonate Greases 1 and 2) or 620 kgf (Calcium Sulfonate Grease 3) (see Example 3 for further test information), Calcium Sulfonate Grease 4 exhibited a four-ball weld load of only 600 kgf. These less favorable properties are likely caused by an interaction of the Catalysts 320, the HiTEC 350, and the VANLUBE 829. While this grease may be satisfactory for some uses, it was not selected for further testing.

Example 2

NLGI Grade Testing and Other Standard Testing

Greases formed in accordance with teachings of the present disclosure may have a National Lubricating Grease Institute (NLGI) grade of 1, 2 or 3. NLGI Grade is a widely used classification for lubricating greases. It was established by the National Lubricating Grease Institute. Greases are classified in one of nine grades based on their consistency.

NLGI Grade alone is not sufficient for specifying the grease for a particular application but it is a useful qualitative measure. While the science of tribology is still developing, NLGI Grade, in combination with other test-based properties is one method for determining the potential suitability of various greases for a specific application.

The nine grades are defined by a range of worked penetration test results. The NLGI grade for a specific grease is determined using two test apparatus. The first apparatus consists of a closed container and a piston-like plunger. The face of the plunger is perforated to allow grease to flow from one side of the plunger to another as the plunger is worked up and down. The test grease is inserted into the container and the plunger is stroked 60 times while the test apparatus and grease are maintained at a temperature of 25° C.

Once worked, the grease is placed in a penetration test apparatus. This apparatus consists of a container, a specially-configured cone and a dial indicator. The container is filled with the grease and the top surface of the grease is smoothed over. The cone is placed so that its tip just touches the grease surface and a dial indicator is set to zero at this position. When the test starts the weight of the cone will cause it to penetrate into the grease. After a specific time interval the depth of penetration is measured.

Table 3 shows the NLGI grades and the worked penetration ranges.

TABLE 3

NLGI Grades

| NLGI Grade | NLGI Grade Worked penetration after 60 Strokes at 25° C. (0.1 mm) | Appearance |
|---|---|---|
| 000 | 445-475 | fluid |
| 00 | 400-430 | fluid |
| 0 | 355-385 | very soft |
| 1 | 310-340 | soft |
| 2 | 265-295 | moderately soft |
| 3 | 220-250 | semi-fluid |
| 4 | 175-205 | semi-hard |
| 5 | 130-160 | hard |
| 6 | 85-115 | very hard |

NLGI Grades 000 to 1 are used in applications requiring low viscous friction. Examples include enclosed gear drives operating at low speeds and open gearing. Grades 0, 1 and 2 are used in highly loaded gearing. Grades 1 through 4 are often used in rolling contact bearings where grade 2 is the most common. (See <<http://en.wikipedia.org/wiki/NLGI_Grade" NLGI Grade>> last visited Jan. 31, 2007.)

Grade of greases of the present disclosure may also be evaluated by ASTM D217, incorporated by reference in material part herein. Other grease properties such as dropping point may be evaluated by ASTM 2256, oil separation may be evaluated by ASTM 1742, and load carrying properties of the grease may be evaluated by four-ball tester (ASTM D2596) or Timken (ASTM D2509) (both incorporate by reference in material part herein). These are useful measures on the physical properties and bench performance of grease, however, are not necessarily indicative of the usability of grease required in the actual roller cone bit applications of present disclosure.

Example 3

Journal Bearing Test

A journal bearing test was developed to assess the performance characteristics of greases of the current disclosure for proper lubrication to prevent seizure/catastrophic failures and reduce wear and friction.

To this end, a load-ramping test sequence was developed for the journal bearing tester to characterize the grease's lubrication performance. The journal bearing tester was initialized at 2,700 kgf, 200 rpm conditions.

Bearing loading was incremented until reaching a level of 12,000 kgf or occurrence of bearing seizure, then rpm was raised incrementally until 400 rpm was reached. Tests were repeated numerous times until a seizure limit of the test grease was determined. A pass was awarded whenever the test grease was capable of completing the loading up to 12,000 kgf.

Test results from the journal bearing test were compared to bench test data such as those generated by four-ball weld tests. The four-ball tester is widely used in drilling bit grease applications to measure weld load and non-seizure load. Because of the limited point to point contact, the resulting contact pressure is extremely high and is usually higher than the level experienced in drill bit bearings. Hence, test results from a four-ball tester are a good representation of the effectiveness of the extreme pressure (EP) additives of the test grease.

It was found that for all greases formulated with the same additive package and tested under the same ramp conditions (see Table 4), quite surprisingly, test grease without calcium sulfonate as the thickener (comparative example one), despite a high four-ball weld load, failed all tests on the journal bearing tester. On the other hand, Calcium Sulfonate Grease 1, which is a PAO oil-based grease with a major portion of calcium sulfonate, scored consistently "all pass" in the journal bearing tester. Calcium Sulfonate Grease 2, which is a mineral oil-based grease with a major portion of calcium sulfonate, had two passes and one borderline failure at 11,000 kgf. Calcium Sulfonate Grease 3, which was a mixture grease containing a primary calcium sulfonate thickener and a secondary calcium complex thickener, had one pass and two borderline failures (11,000 kgf). This clearly demonstrated the outstanding lubrication properties calcium sulfonate greases of the present disclosure.

TABLE 4

Grease Tribological Performance

| ID | FB Weld Load Base Grease | FB Weld Load Finished Grease | Journal Bearing Test |
|---|---|---|---|
| Calcium Sulfonate Grease 1 | 400 Kgf | 800 Kgf+ | 3 PASS |
| Calcium Sulfonate Grease 2 | 400 Kgf | 800 Kgf+ | 2 Pass 1 Fail |
| Calcium Sulfonate Grease 3 | | 620 Kgf | 1 Pass 2 Fail |
| Comparative Ex. 1 | 315 Kgf | 800 Kgf | 3 FAIL |

Example 4

Oscillating Stress Level Test

Dropping point, for example as described in ASTM D2265 (incorporated in material part by reference herein), is typically used to measure consistency and high temperature suitability but it does not adequately distinguish greases that will perform well in downhole conditions from those that will not. A different method, called the Oscillating stress level test, was developed. This test is designed to determine the flow characteristics of grease in its ability to properly transfer or propagate pressure signals under high thermal stress during sever subterrain drilling. First, a test grease was subjected to thermal aging at 177° C. for 16 hours in a forced air oven. Subsequently the flow point of the aged grease mixture was assessed through the measurement of G', G" and represented by the corresponding oscillatory stress level (NLGI Paper #812 "Calcium Sulfonate Grease Making Procedures" and NLGI Paper 801 "Temperature-Dependent Rheology and Tribology of Lubricating Greases," both incorporated in material part by reference herein). An increase in the flow point or the oscillating stress level indicates grease that is more resistant to flow and therefore has a lower ability to transfer pressure.

Calcium sulfonate based greases of the present disclosure (Calcium Sulfonate Greases 1 and 2), regardless of whether made from PAO or mineral oil, after thermal aging, have a oscillatory stress two orders of magnitude less than that of traditional metal complex soap grease (Comparative Example 1). Mixing a calcium sulfonate base grease into calcium complex soap grease (Calcium Sulfonate Grease 3) with the same additives causes an improvement over the calcium complex soap grease alone. Further, the change in flow point before and after thermal aging was significantly less in Calcium Sulfonate Greases 1 and 2. These grease exhibited a zero order of magnitude change, while the greases containing more calcium complex soap grease exhibited a change of two orders of magnitude. This demonstrates the calcium sulfonate greases of the current disclosure are more effective than calcium complex soap greases as a pressure sensing media. (See Table 5.)

TABLE 5

Flow Point (Oscillating Stress Level) Before and After Thermal Aging at 177° C. for 16 hours

| | Dropping point | Flow Point Osc. Stress (Pa) Initial | After | Order of Magnitude Change |
|---|---|---|---|---|
| Calcium Sulfonate Grease 1 | >300° C. | 247 | 240 | 0 |
| Calcium Sulfonate Grease 2 | >300° C. | 150 | 100 | 0 |
| Calcium Sulfonate Grease 3 | >300° C. | 49 | 1159 | 2 |
| Comparative Ex. 1 | >300° C. | 52 | 1346 | 2 |

Example 5

Proposed One-Step Synthesis of Calcium Sulfonate Complex Grease

Although not tested in this example, the following method, based on the remainder of this disclosure, is expected to yield a calcium sulfonate complex grease according to the present disclosure.

A calcium sulfonate complex grease may be prepared in a grease kettle according to the procedure provided in U.S. Pat. No. 4,560,489 (Witco) by mixing 42 wt % 400 TBN commercially available overbased calcium sulfonate (which contained approximately 40-50% by weight diluent oil), 2 wt % dodecyl sulfonic acid, 3% 12-hydrox stearic acid, 0.5 wt % acetic acid, 3 wt % lime, 4 wt % water. The formulation may be balanced with PAO or mineral oil and through effective stirring and heating up to 140° C. over a period that is sufficient to produce the calcium sulfonate complex base grease. The calcium sulfonate complex base grease will likely have a sharp IR peak at 880 $cm^{-1}$, indicative of the formation of calcite structure, a TBN of 130-160 and a calcium content of 6-6.7 wt %. The weight ratio of sulfonate base/complex grease may be estimated at 10/1.

This calcium sulfonate complex base grease is expected to be a close match to the base grease used in Calcium Sulfonate Grease 1 and 2. Subsequent addition of the same base oil and additive package of Calcium Sulfonate Grease 1 in the same grease kettle, or in a separate blend vessel, is expected to result in a high performance grease composition according to the present disclosure. By increasing the content of 12-hydroxy stearic acid or other fatty acids, the resulting grease composition may have a reduced sulfonate/complex base ratio, and may ultimately achieve a similar composition to that disclosed in Calcium Sulfonate Grease 3.

A significant reduction in the weight ratio of sulfonate to complex base is expected to adversely affect the load carrying and high temperature rheology performance of the grease. However, using the teachings of the present specification and knowledge of one of ordinary skill in the art, it is possible that one can vary the weight ratio of sulfonate/complex base thickener to provide additional performance benefits (e.g. greater range of grease workability) and to improve the economics of the grease without jeopardizing the load carrying and high temperature rheology performance.

While embodiments of this disclosure have been depicted, described, and are defined by reference to specific example embodiments of the disclosure, such references do not imply a limitation on the disclosure, and no such limitation is to be inferred. The subject matter disclosed is capable of considerable modification, alteration, and equivalents in form and function, as will occur to those ordinarily skilled in the pertinent art and having the benefit of this disclosure. The depicted and described embodiments of this disclosure are examples only, and are not exhaustive of the scope of the disclosure. For example, variations in grease additives, amounts of grease components, and how the grease compositions are mixed may made and evaluated using the description of this specification.

The invention claimed is:

1. A roller cone drill bit operable to form a wellbore extending through a downhole formation comprising:

a bit body having at least one support arm extending therefrom;

a respective cone assembly rotatably mounted on a spindle extending from each support arm;

a grease container disposed in each support arm;

at least one grease passageway disposed in each support arm to communicate a grease disposed within the grease chamber to bearing surfaces associated with rotatably supporting the respective cone assembly; and a rock bit grease sealed within the bit body comprising:

a thickener comprising a metal sulfonate thickener;

a base oil selected from the group consisting of a mineral oil, a synthetic oil, and combinations thereof;

at least one solid additive selected from the group consisting of graphite, polytetrafluoroethylene, silica, inorganic sulfur-containing solids, inorganic phosphorus-containing solids, inorganic boron-containing solids, and any combinations thereof; and at least one oil-soluble additive selected from the group consisting of extreme pressure (EP) additives, oxidation inhibitors, wear and friction reducing additives, polymer additives for enhanced grease integrity, pour point depressant, or corrosion inhibitor, and any combinations thereof.

2. The roller cone drill bit of claim 1, wherein the rock bit grease further comprises a second thickener comprising a metal complex soap thickener, detergent, or non-soap thickener.

3. The roller cone drill bit of claim 1, wherein the grease further comprises a second thickener comprising a metal complex soap thickener or non-soap thickener.

4. The roller cone drill bit of claim 1, wherein the thickener further comprises:

at least 50% by weight calcium sulfonate thickener; and a calcium complex soap thickener.

5. The roller cone drill bit of claim 1, wherein the thickener comprises at least approximately 40% by weight metal sulfonate thickener.

6. The roller cone drill bit of claim 1, wherein the thickener comprises at least approximately 90% by weight metal sulfonate thickener.

7. The roller cone drill bit of claim 1, wherein the thickener comprises at least approximately 95% by weight metal sulfonate thickener.

8. The roller cone drill bit of claim 1, wherein the metal sulfonate thickener comprises an alkaline earth metal sulfonate thickener.

9. The roller cone drill bit of claim 8, wherein the metal sulfonate thickener comprises a calcium sulfonate thickener.

10. The roller cone drill bit of claim 3, wherein the metal complex soap comprises an aluminum or lithium complex soap.

11. The roller cone drill bit of claim 3, wherein the metal complex soap comprises a calcium complex soap.

12. The roller cone drill bit of claim 3, wherein the non-soap thickener comprises at least one thickener selected from the group consisting of: silica, clays, silica gels, carbon black, polyurea, synthetic organic materials, and any combinations thereof.

13. The roller cone drill bit of claim 1, wherein the grease comprises at least approximately 40% up to approximately 100% by weight metal sulfonate thickener.

14. The roller cone drill bit of claim 1, wherein the grease prevents seizure in at least one journal bearing test at a bearing loading of 12,000 kgf at 400 rpm.

15. The roller cone drill bit of claim 1, wherein the grease exhibits a change in flow point after thermal aging at 16 hours at 177° C. of one order of magnitude or less.

16. The roller cone drill bit of claim 1, wherein the grease has a dropping point temperature greater than approximately 300° C.

17. The roller cone drill bit of claim 1, wherein the grease has a worked penetration within NLGI grades 1, 2 and 3.

18. The roller cone drill bit in claim 1, wherein the grease is operable to reduce friction between bearing surfaces associated with a roller cone drill bit operating at temperatures significantly above 150° C.

19. The roller cone drill bit of claim 1, wherein the grease is non-toxic.

* * * * *